US006250481B1

(12) United States Patent
Chang et al.

(10) Patent No.: US 6,250,481 B1
(45) Date of Patent: Jun. 26, 2001

(54) BATHROOM RACK

(76) Inventors: Ching-Yi Chang; Ching-Chih Chang, both of No. 103-29, Sec. 1, Chang Ho Rd., Changhua City (TW)

( * ) Notice: Subject to any disclaimer, the term of this patent is extended or adjusted under 35 U.S.C. 154(b) by 0 days.

(21) Appl. No.: 09/533,665

(22) Filed: Mar. 23, 2000

(51) Int. Cl.[7] ..... A47F 5/08

(52) U.S. Cl. ..... 211/87.01; 248/303; 211/119.009; 4/559

(58) Field of Search ..... 211/105.1–105.2, 211/87.01, 123, 119.009, 119.011; 403/186–187; 248/303–304, 351, 309.1, 315, 224.7, 220.21, 220.22, 222.52, 261–262, 254; 4/559, 576.1, 577.1; D6/524, 546, 547, 549, 550

(56) References Cited

U.S. PATENT DOCUMENTS

| | | | | |
|---|---|---|---|---|
| 1,838,935 | * | 12/1931 | Fixsen | 248/251 |
| 4,907,771 | * | 3/1990 | Wang | 248/251 |
| 5,026,013 | * | 6/1991 | Robbins | 248/251 |
| 5,071,099 | * | 12/1991 | Kuo | 248/222.21 |
| 5,076,523 | * | 12/1991 | Wang | 248/222.21 |
| 5,186,427 | * | 2/1993 | Semcheck | 248/251 |
| 5,402,977 | * | 4/1995 | Korfgen et al. | 248/309.1 |
| 5,566,917 | * | 10/1996 | Wu | 248/311.2 |
| 5,664,751 | * | 9/1997 | Lan | 248/251 |
| 5,730,413 | * | 3/1998 | Chen | 248/489 |
| 5,799,804 | * | 9/1998 | Sharpe | 211/105.1 |
| 5,875,903 | * | 3/1999 | Chen | 211/105.1 |
| 5,893,544 | * | 4/1999 | Chen | 248/220.21 |
| 5,967,476 | * | 10/1999 | Chen | 248/222.14 |
| 6,012,692 | * | 1/2000 | Meck | 248/251 |
| 6,113,045 | * | 9/2000 | Kuo | 248/251 |

* cited by examiner

*Primary Examiner*—Daniel P. Stodola
*Assistant Examiner*—Jennifer E. Novosad
(74) *Attorney, Agent, or Firm*—Rabin & Champagne, P.C.

(57) ABSTRACT

A bathroom rack comprises a fastening seat provided with a female retainer, an article-holding frame extending from the fastening seat, a plurality of fastening screws for fastening the fastening seat with a bathroom wall, and a decorative cover provided with a male retainer. The decorative cover is detachably fastened with the fastening seat such that the male retainer of the decorative cover is engaged with the female retainer of the fastening seat.

2 Claims, 6 Drawing Sheets

BATHROOM RACK

FIELD OF THE INVENTION

The present invention relates generally to the accessories of a bathroom, and more particular to a bathroom rack.

BACKGROUND OF THE INVENTION

The conventional bathroom racks are securely fastened onto the wall of a bathroom that they can not be removed or replaced with ease and speed. In addition, the conventional bathroom racks are provided with a fixed decorative cover.

SUMMARY OF THE INVENTION

The primary objective of the present invention is to provide a bathroom rack comprising a fastening seat, an article holding frame extending form the fastening seat, and a decorative cover to conceal the fastening seat which is fastened to a bathroom wall by a plurality of fastening screws.

The objective, features, and advantages of the present invention will be more readily understood upon a thoughtful deliberation of the following detailed description of the preferred embodiment of the present invention with reference to the accompanying drawings.

DETAILED DESCRIPTION OF THE PREFERRED EMBODIMENT

Figure 1:
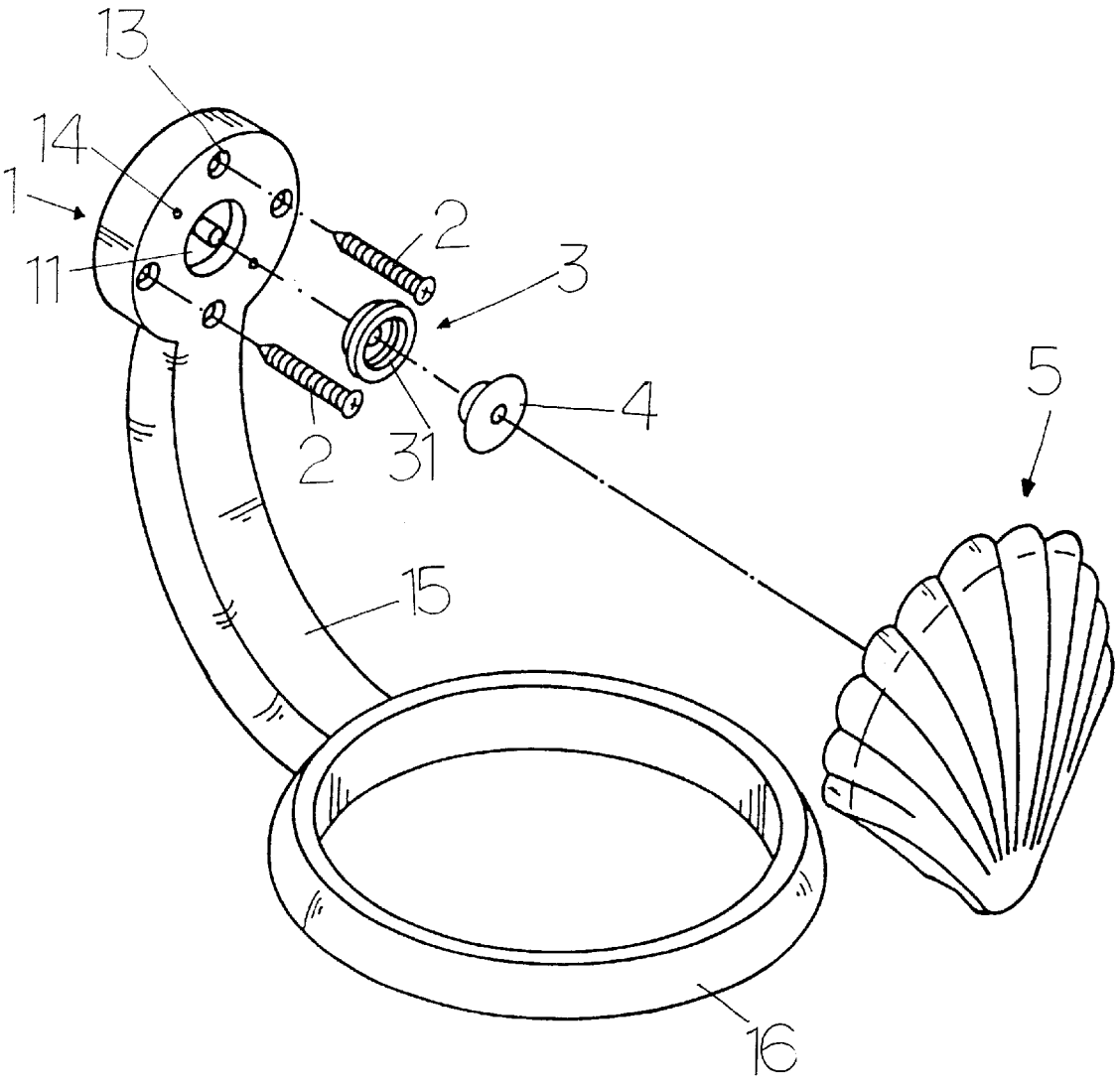
FIG. 1 shows a partial exploded view of a first preferred embodiment of the present invention.
Figure 2:
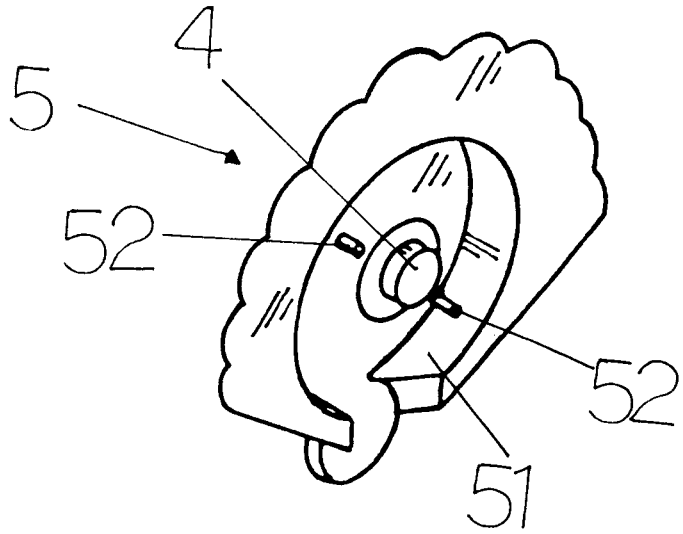
FIG. 2 shows a perspective view of a decorative cover of the first preferred embodiment of the present invention.
Figure 3:
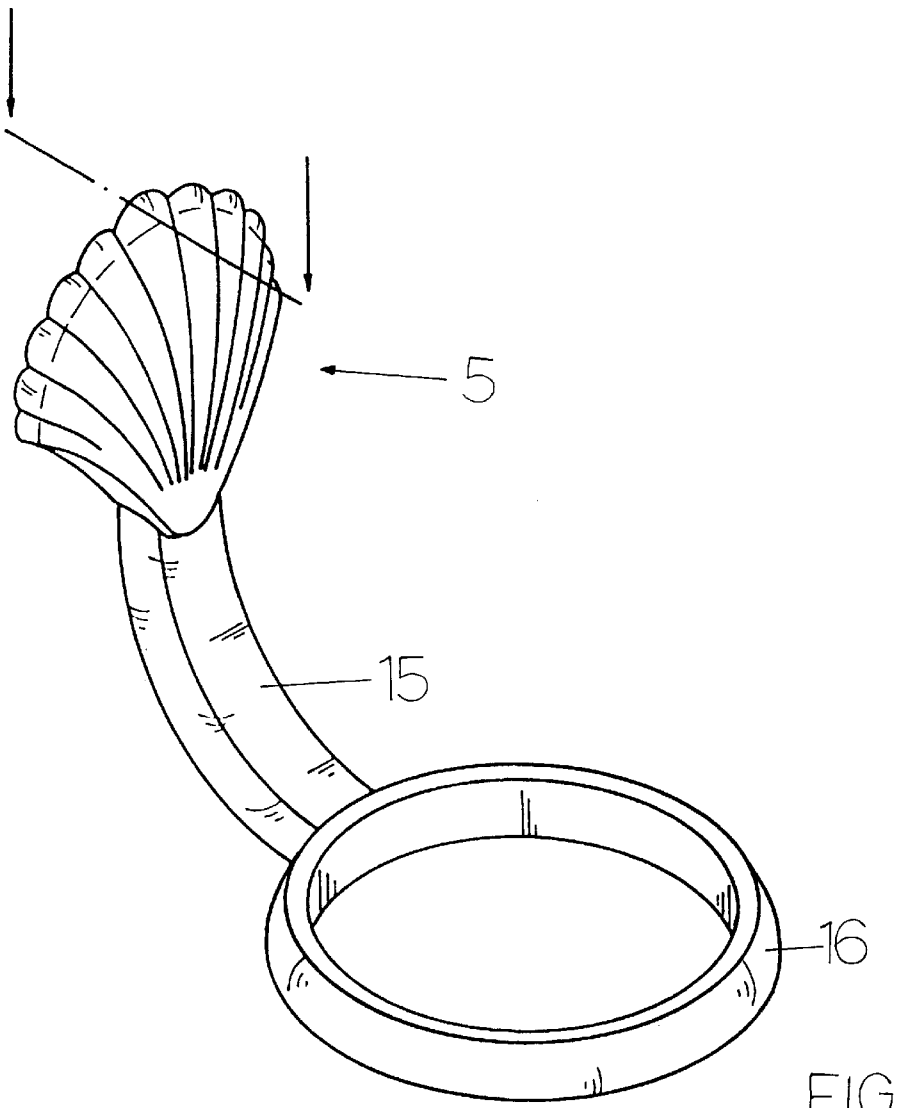
FIG. 3 shows a perspective view of the first preferred embodiment of the present invention in combination.
Figure 4:
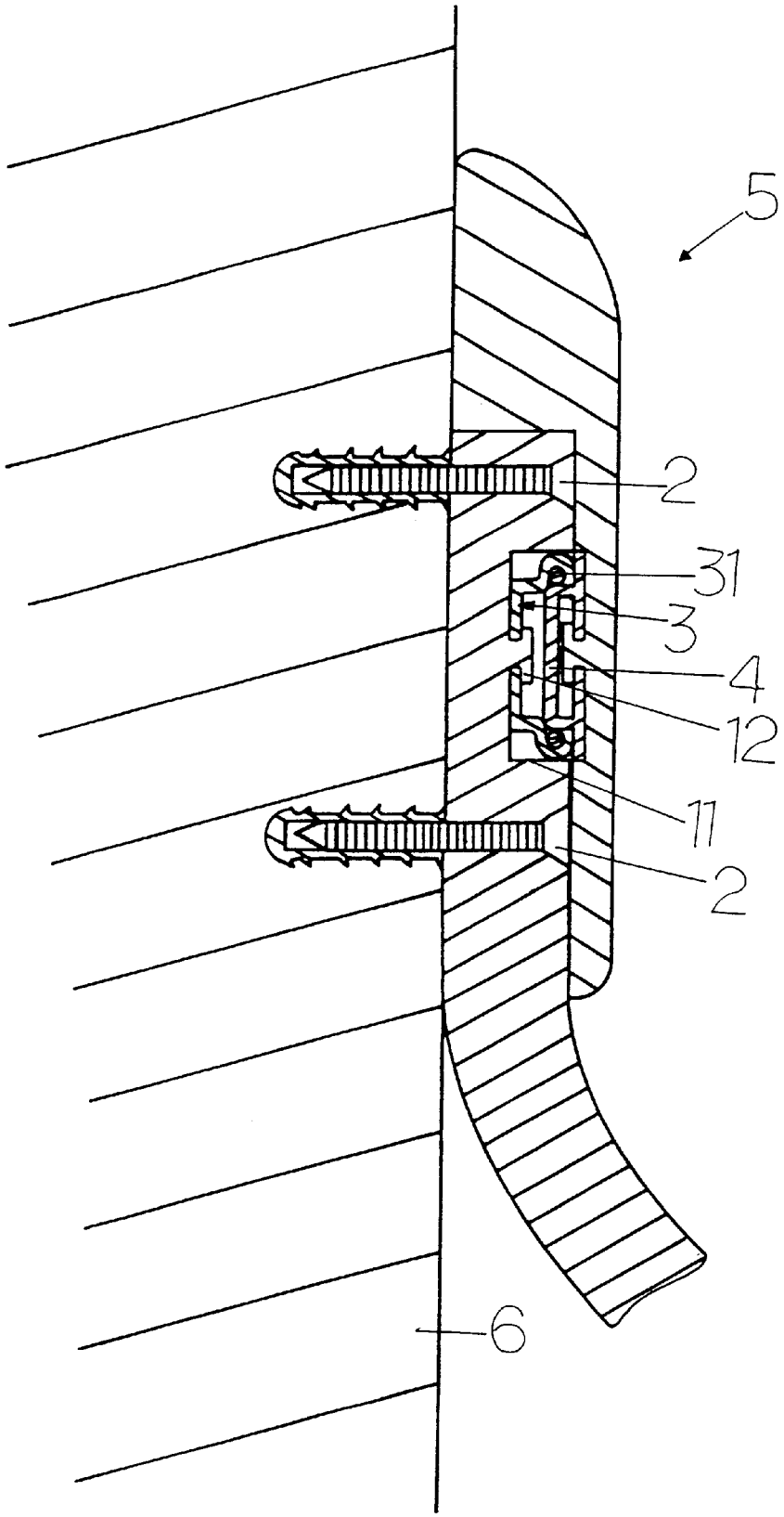
FIG. 4 shows a sectional view of the first preferred embodiment of the present invention.
Figure 5:
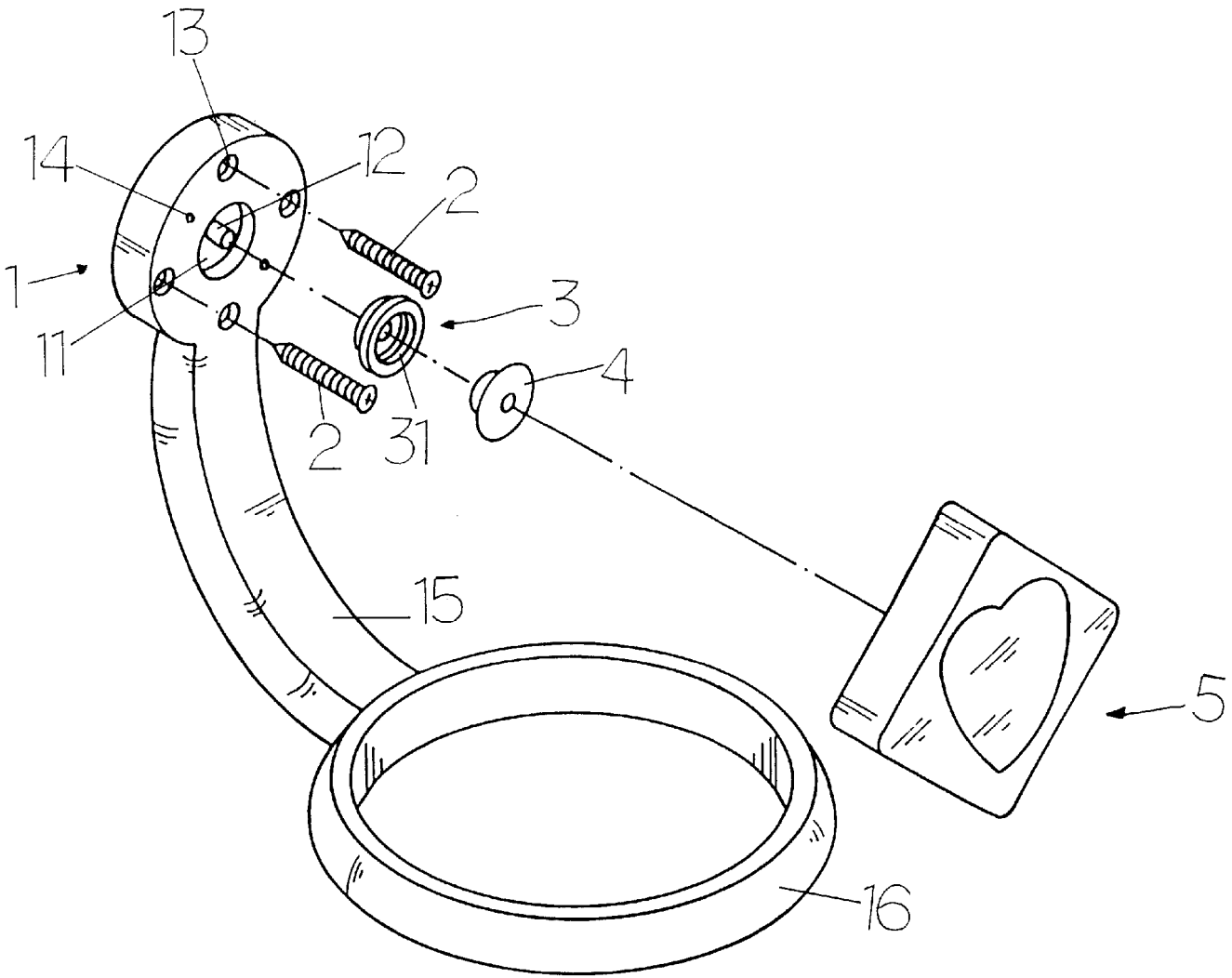
FIG. 5 shows a partial exploded view of a second preferred embodiment of the present invention.
Figure 6:
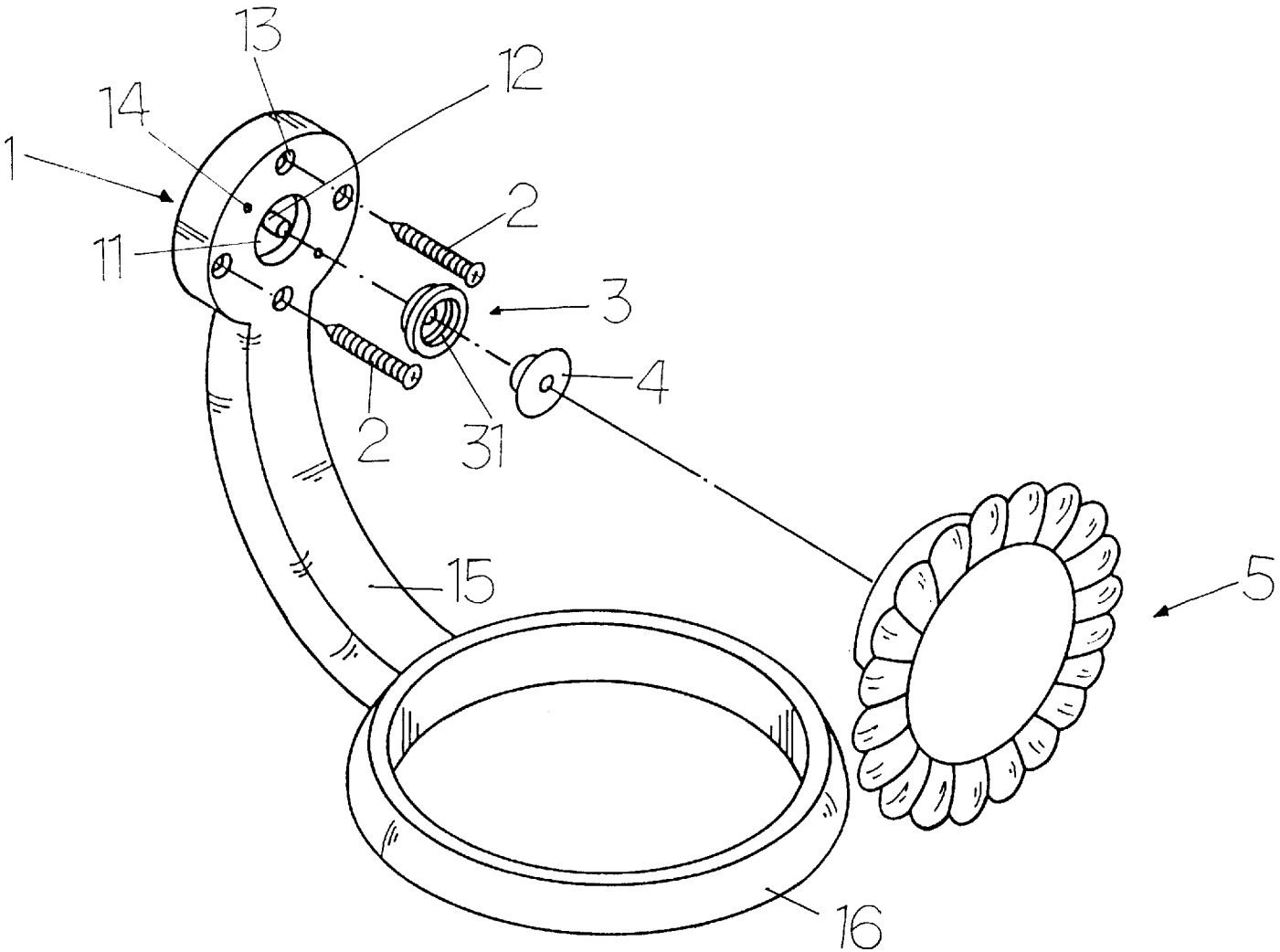
FIG. 6 shows a partial exploded view of a third preferred embodiment of the present invention.

As shown in FIGS. 1–4, a bathroom rack embodied in the present invention comprises a fastening seat 1, a plurality of fastening screws 2, a female retainer 3, a male retainer 4, a decorative cover 5, and an article-holding frame 16 extending from the fastening seat. The article-holding frame 16 is located at one end of an extension arm 15 extending from the fastening seat 1, which is fastened with a bathroom wall 6 by a plurality of fastening screws 2. The fastening screws 2 are fastened onto the bathroom wall 6 via through holes 13 of the fastening seat 1. The fastening seat 1 is provided in the outer surface thereof with a recess 11 in which a rivet 12 is disposed. The fastening seat 1 is further provided in the outer surface thereof with two check holes 14 opposite to each other. The female retainer 3 is provided therein with a metal ring 31 and is disposed in the recess 11 of the fastening seat 1. The decorative cover 5 is provided in the internal side thereof with a receiving slot 51 in which the male retainer 4 is disposed. The receiving slot 51 is provided with two pins 52. The decorative cover 5 is joined with the fastening seat 1 such that fastening seat 1 is received in the receiving slot 51 of the cover 5, and that the two pins 52 are inserted into the two check holes 14 of the fastening set 1, and further that the male retainer 4 is detachably engaged with the female retainer 3, with the male retainer 4 being detachably held by the metal ring 31 of the female retainer 3. The decorative cover 5 of the first preferred embodiment of the present invention has a sectorial shape. The decorative cover 5 of the present invention may be of any geometric form, such as the square form as shown in FIG. 5, the round form as shown in FIG. 6.

What is claimed is:

1. A bathroom rack comprising:

a fastening seat provided in an outer surface thereof with a recess and two check holes, said recess having a rivet, said fastening seat further provided with a plurality of through holes whereby said fastening seat is adapted to be fastened to a bathroom wall by a plurality of fastening screws extending through said through holes;

a female retainer disposed in said recess of said fastening seat and having a metal ring seated therein; and an article holding frame extending from said fastening seat; and a decorative cover provided on an internal side thereof with a receiving slot, a male retainer, and two pins disposed in said receiving slot whereby said decorative cover is detachably fastened to said fastening seat such that said two pins of said decorative cover are received in said two check holes of said fastening seat, and said male retainer is detachably received within said female retainer disposed in said recess of said fastening seat and is held therein by engagement with said metal ring.

2. The bathroom rack as defined in claim 1, wherein said decorative cover is one of a shell, square or circular geometric form.

* * * * *